US009119465B2

(12) United States Patent
Grace

(10) Patent No.: US 9,119,465 B2
(45) Date of Patent: Sep. 1, 2015

(54) COLLAPSIBLE TABLE

(71) Applicant: Daniel R. Grace, Old Saybrook, CT (US)

(72) Inventor: Daniel R. Grace, Old Saybrook, CT (US)

(73) Assignee: GCI Outdoor, Inc., Higganum, CT (US)

( * ) Notice: Subject to any disclaimer, the term of this patent is extended or adjusted under 35 U.S.C. 154(b) by 0 days.

(21) Appl. No.: 14/044,321

(22) Filed: Oct. 2, 2013

(65) Prior Publication Data

US 2014/0090582 A1 Apr. 3, 2014

Related U.S. Application Data

(60) Provisional application No. 61/708,832, filed on Oct. 2, 2012.

(51) Int. Cl.

| | |
|---|---|
| ***A47B 3/02*** | (2006.01) |
| ***A47B 9/20*** | (2006.01) |
| ***A47B 9/14*** | (2006.01) |
| *A47B 9/00* | (2006.01) |

(52) U.S. Cl.

CPC ... *A47B 3/02* (2013.01); *A47B 9/14* (2013.01); *A47B 9/20* (2013.01); *A47B 2009/006* (2013.01)

(58) Field of Classification Search

CPC .... A47B 3/02; A47B 2003/025; A47C 9/105; D06F 81/04

USPC ..... 108/118, 116, 119; 248/164, 161, 408, 248/409, 423

See application file for complete search history.

(56) References Cited

U.S. PATENT DOCUMENTS

| | | | | | |
|---|---|---|---|---|---|
| 1,608,924 | A | | 11/1926 | Brown | |
| 1,706,192 | A | | 3/1929 | Smith | |
| 3,462,773 | A | | 8/1969 | Triplett | |
| 3,692,358 | A | * | 9/1972 | Sung | 108/118 |
| 3,980,026 | A | | 9/1976 | Thomas | |
| 4,157,089 | A | * | 6/1979 | Loughrey | 108/116 |
| 4,168,669 | A | * | 9/1979 | Arnoff | 108/116 |
| 4,190,001 | A | * | 2/1980 | Cecala | 108/161 |
| 4,229,038 | A | * | 10/1980 | Drost | 108/173 |
| 4,415,149 | A | * | 11/1983 | Rees | 108/116 |
| 4,592,287 | A | * | 6/1986 | Thygeson | 108/118 |
| 4,643,103 | A | | 2/1987 | Jorgensen | |
| 4,793,265 | A | * | 12/1988 | Morris | 108/118 |

(Continued)

OTHER PUBLICATIONS

International Search Report for PCT/US2013/063112 dated Dec. 20, 2013.

*Primary Examiner* — Jose V Chen

(74) *Attorney, Agent, or Firm* — McCormick, Paulding & Huber, LLP

(57) ABSTRACT

A collapsible table structure comprises a tabletop and a plurality of folding leg assemblies pivotally attached thereto. Each leg assembly comprises a first leg and a second leg connected to each other at a pivot coupling defining an unintruding common axis for movement between an open condition generally resembling an X-shaped configuration and a closed condition wherein the legs, as well as the tabletop, are generally parallelly disposed in a common plane. Each leg is formed by at least two telescopically connected leg sections freely movable through and transversely of the unintruding common axis in moving between extended and retracted positions relative to each other. Each leg includes a locking mechanism for retaining a lower leg section in an extended position. The table structure further includes means for releasing the locking mechanism to facilitate collapsing of the table to its closed condition.

18 Claims, 9 Drawing Sheets

(56) References Cited

U.S. PATENT DOCUMENTS

| | | | | | |
|---|---|---|---|---|---|
| 4,850,286 | A | * | 7/1989 | Cline | 108/118 |
| 4,927,128 | A | | 5/1990 | O'Brian | |
| 4,934,638 | A | * | 6/1990 | Davis | 108/118 |
| 4,991,325 | A | * | 2/1991 | Teduschi | 108/116 |
| 5,483,901 | A | * | 1/1996 | Tisbo et al. | 108/119 |
| 5,584,254 | A | * | 12/1996 | Williams | 108/118 |
| D407,235 | S | * | 3/1999 | Cunningham et al. | D6/429 |
| 6,032,914 | A | | 3/2000 | Bastida | |
| 6,141,828 | A | | 11/2000 | Kuo | |
| 6,467,739 | B1 | | 10/2002 | Jou | |
| 6,715,429 | B2 | * | 4/2004 | Adams et al. | 108/118 |
| 6,722,293 | B2 | * | 4/2004 | Lee | 108/118 |
| 6,840,182 | B2 | | 1/2005 | Price | |
| 2006/0225624 | A1 | | 10/2006 | Grace | |
| 2009/0178195 | A1 | | 7/2009 | Zheng | |
| 2012/0204770 | A1 | | 8/2012 | Grace | |

* cited by examiner

COLLAPSIBLE TABLE

CROSS-REFERENCE TO RELATED APPLICATION

This application claims the benefit of U.S. Provisional Application No. 61/708,832, filed Oct. 2, 2012, which is incorporated herein by reference.

FIELD OF THE INVENTION

This invention relates in general to collapsible articles of furniture and more particularly to a portable and collapsible table structure.

BACKGROUND OF THE INVENTION

The present invention is concerned with improvements in portable and collapsible furniture of simple durable quality construction which may be collapsed to minimal size to satisfy the needs of the average user, including campers, picnickers, and the like. In particular, the present invention is directed to a portable and collapsible structure, convenient for use as a table, stand, or support frame, that can easily be set up for use and likewise collapsed to a compact bundle for storage and/or transport.

Common portable table designs include standard folding tables consisting of a tabletop fixed to folding legs mounted thereunder. To set up such a table, the legs are folded out, often one-by-one, and locked into a set-up condition. To collapse the table for storage, the legs are unlocked and folded within the footprint of the tabletop. Such folding tables are not desirable or convenient for transport because the folded footprint of the table is often identical to the set-up footprint of the table, and thus may not easily fit within the user's vehicle. Typically, a truck, van or large SUV is needed just to transport the table, and even then, the user must compromise other storage space or even seating space in the vehicle. In some alternative designs, the tabletop may be folded in half after the legs are collapsed, but such tables are still very heavy and bulky, and thus not easily transported. Additionally, traditional folding table designs take up a lot of storage space, for example in a closet or basement, even when folded up.

Some portable table designs can be collapsed or broken down into more compact sizes for transport and storage, such as co-pending patent application Ser. No. 13/343,355, entitled "Portable and Collapsible Table Structure," which shares the same inventor as the present invention and is incorporated herein by reference. For example, the tabletop, table support, and table legs can be broken down, folded up, and bundled together for easy transport. In some designs, for example, the tabletop is removed from a table frame and separately folded into a smaller condition. The table frame and legs are separately folded up and collapsed into a bundle. Such tables are especially useful for camping, picnics and travel, where standard tables, including traditional folding tables, are often too bulky and difficult to transport without taking up too much vehicle space.

Small tables and stands, such as TV trays, are available that can be collapsed into a flat storage condition where the tables legs are folded together into a common plane and the tabletop is folded down to a position generally parallel to the collapsed legs. In such designs, however, the table legs are often fixed in length, and as a result, project beyond the footprint of the tabletop, thereby affecting the size of the collapsed table. Where the legs may be reduced in size, the extent to which they can be shortened is typically restricted by existing structure of the table, such as a pivot pin connecting the legs together. In particular, in such prior art designs, no portion of a leg can be telescopically received within the leg past a centrally located pivot point. In this regard, existing collapsible table designs that permit the length of the table legs to be adjusted only allow for an adjustment on the order of a few inches, and such adjustment is merely intended to permit the user to change the table height. Accordingly, such adjustments have little impact on reducing the size of the collapsed table for transport and storage.

The usable size of prior art portable table designs is often limited based on how such tables may be broken down and bundled. For example, it is often the case that in order to decrease the size of the bundle of a collapsed table, the table structure, as set up, must itself be small. However, when the size of the table itself is decreased, the table is often too small for many desired uses. Alternatively, the height of the table is reduced so that the legs do not increase the size of the collapsed table. However, such shorter tables are not ideal for many uses for the table. Thus, while storage and transport space has been optimized in some regards, the utility of the table may be undesirable, and, for example, when a larger table surface is desired, one may need to use two or more small tables together, which ends up requiring more storage and transportation space than a single, larger table. Alternatively, where a larger table surface is desired using a single collapsible table, the size of the collapsed table with a larger tabletop and frame footprint may be too large, bulky and difficult to carry, even when collapsed and bundled. Thus, heretofore it has been difficult to have a portable table that will take up a minimal storage space when broken down without compromising the size or height of the set-up table.

In view of the foregoing, there is a need for a new and improved portable and collapsible table structure that overcomes the problems and drawbacks associated with prior art collapsible tables. Accordingly, it is a general object of the present invention to provide a table structure designed to be collapsed into a minimally-sized bundle for convenient transport and storage, but which can also be easily set up for use without compromising the size of the usable table. Further, it is a general object of the present invention to provide a table structure that is easily collapsed to a minimally-sized bundle without requiring a complicated or cumbersome collapsing procedure.

SUMMARY OF THE INVENTION

In accordance with embodiments of the present invention, there is provided a collapsible table structure, usable as a table, stand or support frame, comprising a tabletop and a plurality of folding leg assemblies pivotally attached to the underside of the tabletop. Each leg assembly preferably comprises a first leg and a second leg connected to each other for pivotal movement between an open condition generally resembling an X-shaped configuration and a closed condition wherein the legs are generally parallelly disposed in a common plane. The tabletop and the folding leg assemblies can be collapsed into a condition where all of the legs and the tabletop are generally parallelly disposed so as to minimize the amount of space taken up by the collapsed table.

In a first aspect of the present invention, each leg member is formed by at least two telescopically connected longitudinally elongated tubular leg sections. As so constructed, a lower leg section can be telescopically retracted within an upper leg section to collapse the table and reduce dimension for storage and/or transport. The lower leg section can be telescopically extended from the upper leg section to a desired length for set-up condition of the table, and more preferably adjusted to various desired lengths for use of the table structure at various desired table heights.

In preferred embodiments of the present invention, two leg members are pivotally connected together via a pivot coupling that enables angular movement of the leg members relative to each other. The lower leg section for each leg member is permitted to telescope within a respective upper leg section past the pivot coupling to reduce the size of a collapsed leg member. In this manner, the size of the legs can be greatly reduced during break down of the table, which in turn reduces the size of the collapsed table structure, thereby taking up less space when the table is collapsed for storage and/or transport.

In accordance with preferred embodiments of the present invention, the tabletop is preferably divided into two parts, with each part being connected to a respective group of legs. More particularly, the table preferably includes two leg assemblies, each comprising a first leg and a second leg. A first tabletop part is pivotally connected to the first leg of each leg assembly. The second tabletop part is pivotally connected to the second leg of each leg assembly. In the set-up condition of the table, the first and second tabletop parts meet to form a generally planar tabletop surface and the first and second legs of each leg assembly are disposed in the open condition, generally resembling an X-shaped configuration. In the collapsed condition of the table, the first and second legs of each leg assembly are disposed in the closed condition, with each leg being generally parallelly disposed in a common plane. The first tabletop part is pivoted down on one side of the closed leg assemblies and the second tabletop part is pivoted down on the other side of the closed leg assemblies. As so folded, the first and second tabletop parts are generally parallel to the closed legs.

In accordance with preferred embodiments of the present invention, the central pivot coupling of each leg assembly does not interfere with the telescoping of each leg member. In this regard, the central pivot coupling defines an unintruding common pivot axis between the leg members. During collapsing of the telescoping lower leg sections of the table, the lower leg sections are freely movable through and transversely of the unintruding common pivot axis, and indeed, may be retracted beyond the pivot axis to greatly reduce the size of the collapsed table.

In another aspect of the present invention, each leg includes a locking mechanism whereby the telescoping lower leg section can be locked in place relative to the upper leg section, particularly when the former is telescopically extended from the latter to a desired length. In preferred embodiments, the locking mechanism comprises a spring-biased detent button operatively positioned in and carried by the lower leg section, that is biased outwardly therefrom and through at least one aperture formed in the wall of the upper leg section, said aperture corresponding to a desired length of the extended leg, to lock the lower leg section in an extended condition relative to the upper leg section.

In a further aspect of the present invention, each tabletop section is provided with bumpers on the underside thereof for releasing the locking means, and furthermore facilitating retraction of all the lower leg sections of the table during collapsing of the table. Preferably, when the tabletop parts are folded down to a collapsed position generally parallel to the closed leg assemblies, the bumpers engage the detent buttons for each lower leg section, automatically releasing said buttons from the respective apertures in each of the upper leg sections so that the legs can be collapsed with the lower leg sections being telescopically retracted within their respective upper leg sections until the table is in its fully collapsed condition. More preferably, the bumpers coordinate retraction of the legs so that the detent buttons for all the legs are released substantially simultaneously. As a result, collapsing of the table can be facilitated and simplified.

In another aspect of the present invention, a collapsible table structure comprises a first and a second leg assembly, each having a pair of longitudinally elongated legs, said legs having a plurality of longitudinally extendible and retractable sections movable between extended and retracted positions relative to each other. The table structure further comprises means for enabling angular movement of the pairs of legs about an unintruding common axis in one and an opposite angular direction, relative to each other between closed and open conditions of the leg assemblies, where the legs in the closed condition are longitudinally parallel to each other; and the legs in the open condition cross each other at the unintruding common axis and present an X-shaped configuration. The extendible and retractable sections of each leg are freely movable through and transversely of the unintruding common axis in moving between said extended and retracted positions. A tabletop pivotally connected atop each of the leg assemblies comprises a first tabletop part pivotally connected to a first leg of each leg assembly and a second tabletop part pivotally connected to a second leg of each leg assembly, such that in a set-up condition of the table structure, where each of the leg assemblies is in its open condition, the tabletop parts collectively define a generally parallel tabletop surface, and such that in a collapsed condition of the table structure, where each of the leg assemblies is in its closed condition, the first tabletop part has a closed condition wherein said tabletop part is generally parallelly disposed on one side of the closed leg assemblies and the second tabletop part has a closed condition wherein said tabletop part is generally parallelly disposed on the other side of the closed leg assemblies. Each leg of the leg assemblies further includes locking means for retaining lower leg sections of said legs in an extended position and the table structure further includes means for releasing each of said locking means when the legs are in the closed condition and the tabletop parts move into their respective closed conditions.

These and other objects, features and advantages of the present invention will become apparent in light of the detailed description of embodiments thereof, as illustrated in the accompanying drawings.

DESCRIPTION OF PREFERRED EMBODIMENTS

Figure 1:
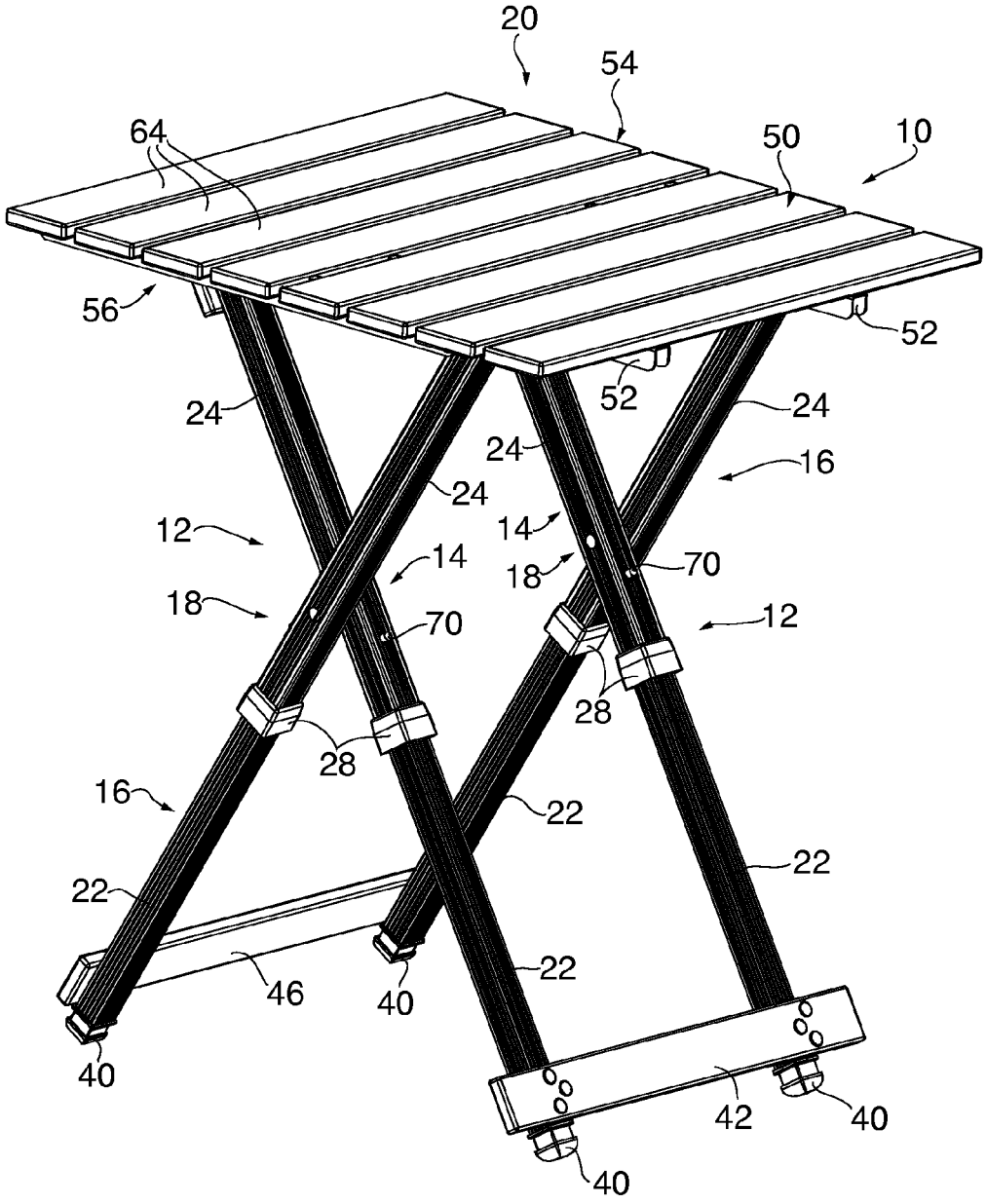
FIG. 1 is a perspective view of a collapsible table structure embodying the present invention in a set-up condition.

In the drawings and in the description that follows, the present invention is illustrated and described with reference to a portable and collapsible table structure embodying the present invention. Such a table structure is convenient for use as a table, stand or support frame that can be easily set up for use and likewise collapsed to a compact bundle of significantly reduced size for storage and/or transport.

Figure 2:
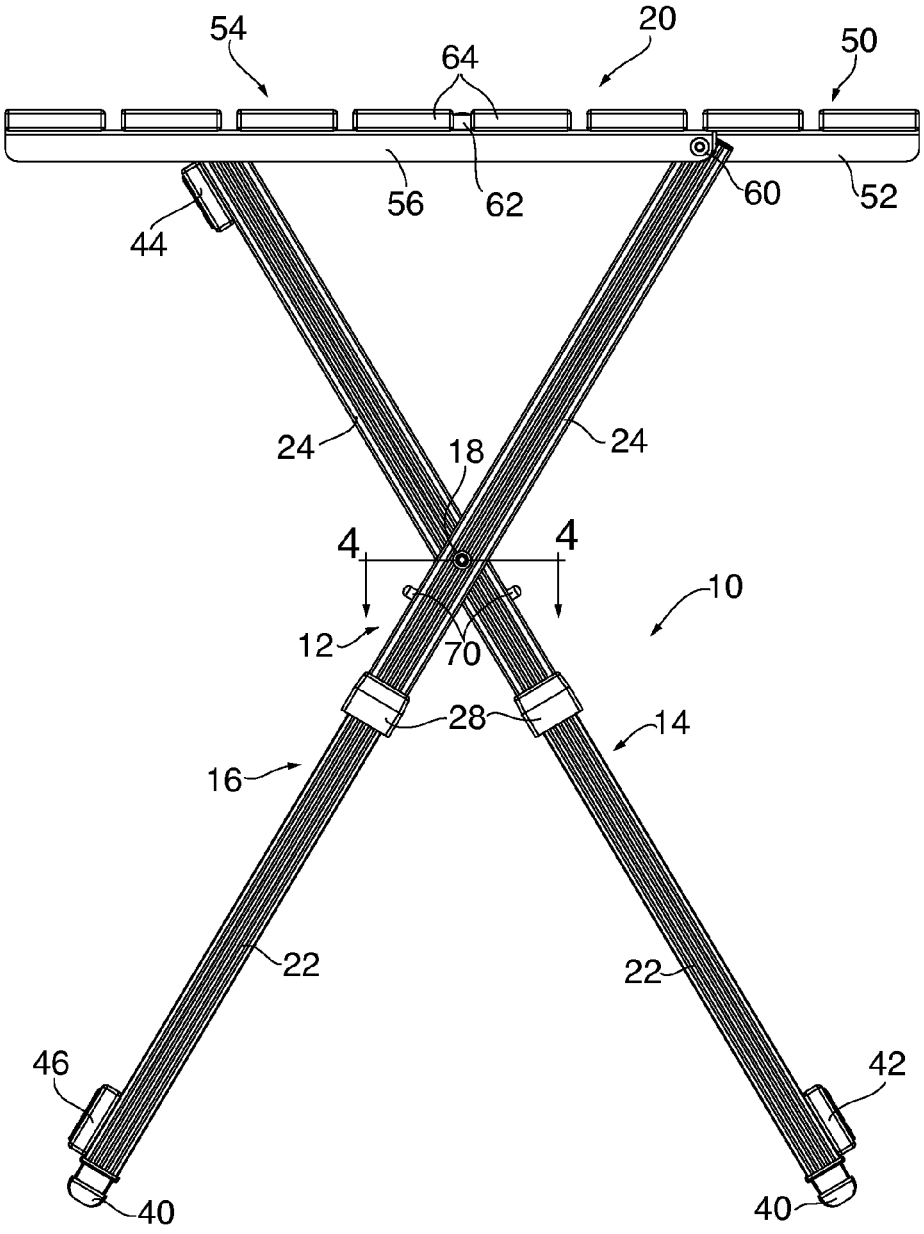
FIG. 2 is a planar end view of the table structure of FIG. 1.
Figure 6:
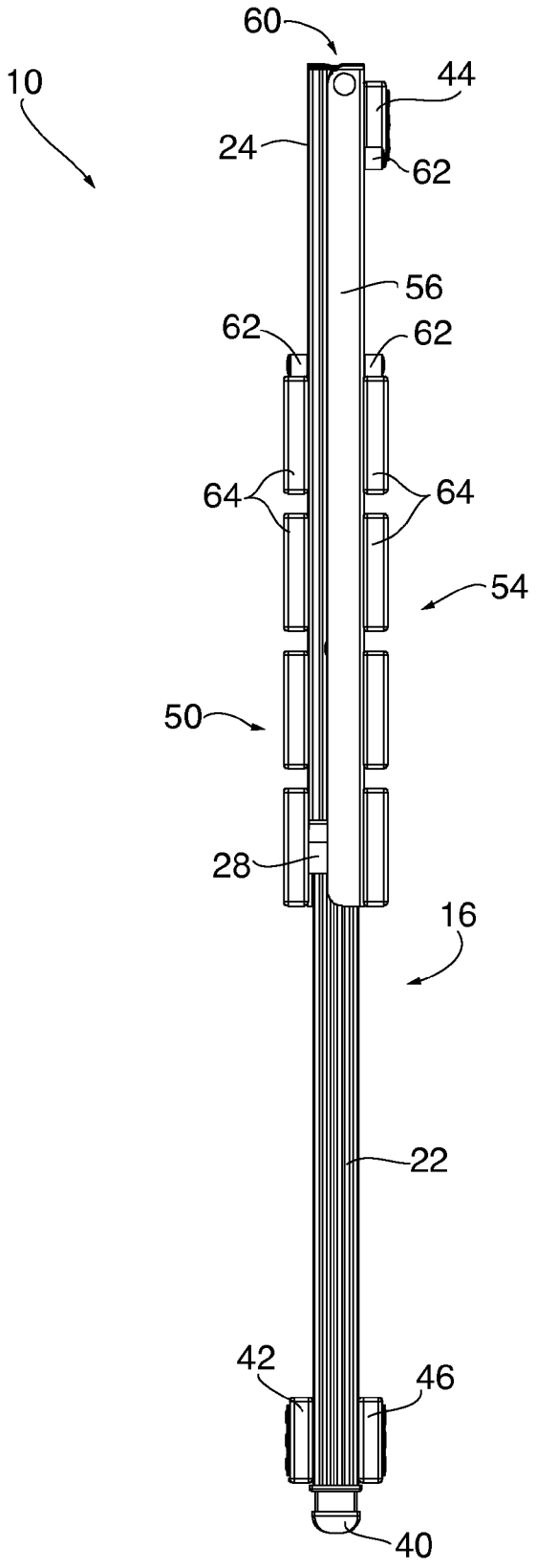
FIG. 6 is a planar end view of the partially collapsed table structure of FIG. 5.
Figure 8:
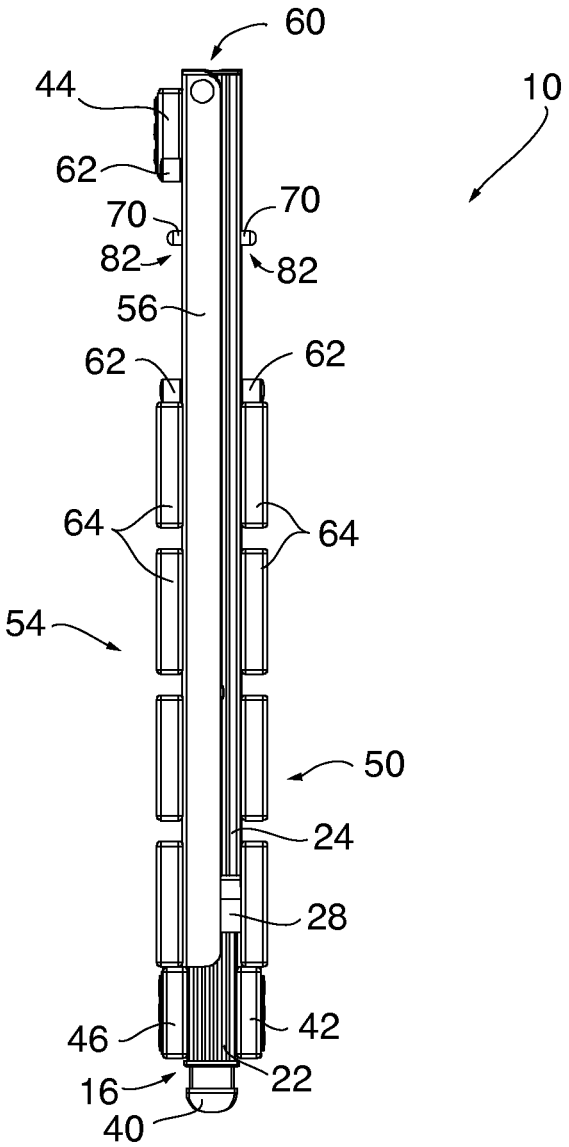
FIG. 8 is a planar end view of the fully collapsed table structure of FIG. 7.

Turning now to the drawings and referring first particularly to FIGS. 1-2, a collapsible two-legged table structure of cross-legged type embodying the present invention is designated generally by the reference number 10. The illustrated table 10 essentially comprises two collapsible leg assemblies 12, each including a first leg 14 and a second leg 16 connected to each other at a centrally-located pivot coupling 18 for pivotal movement about an axis between an open condition generally resembling an X-shaped configuration (FIG. 2) and a closed condition wherein the legs 14 and 16 are generally parallelly disposed in a common plane (FIGS. 6 and 8). The leg assemblies 12 support a tabletop 20 in a generally horizontally disposed position when the table 10 is in its set-up or open condition ready for use, as it appears in FIGS. 1-2.

The legs 14 and 16 are preferably fabricated from aluminum tubing of non-circular cross-section, longitudinally elongated square tubing being presently preferred. In accordance with preferred embodiments of the present invention, each leg 14 and 16 is formed by at least two telescopically connected tubular leg sections. More particularly, each leg 14 and 16 includes a lower leg section 22 and an upper leg section 24 of somewhat larger cross-section. As so constructed, the lower leg section 22 can be telescopically retracted within the upper leg section 24 to collapse the leg 14 or 16, and thereby the table 10, to reduce the table's collapsed dimension for storage and/or transport. Indeed, the reduced size of the collapsed table in accordance with the present invention, where the legs 14 and 16 have been collapsed, is illustrated in FIG. 8, as compared to the partially collapsed table 10 shown in FIG. 6 with the legs extended to a desired length for set up and use. Additionally, the lower leg section 22 can be telescopically adjusted to a desired leg length corresponding to a desired set-up condition for the table 10. In this manner, the size of the legs 14 and 16 is reduced during break down of the table 10, which in turn reduces the size of the collapsed table structure, thereby taking up less space when the table 10 is collapsed for storage and/or transport.

Figure 3:
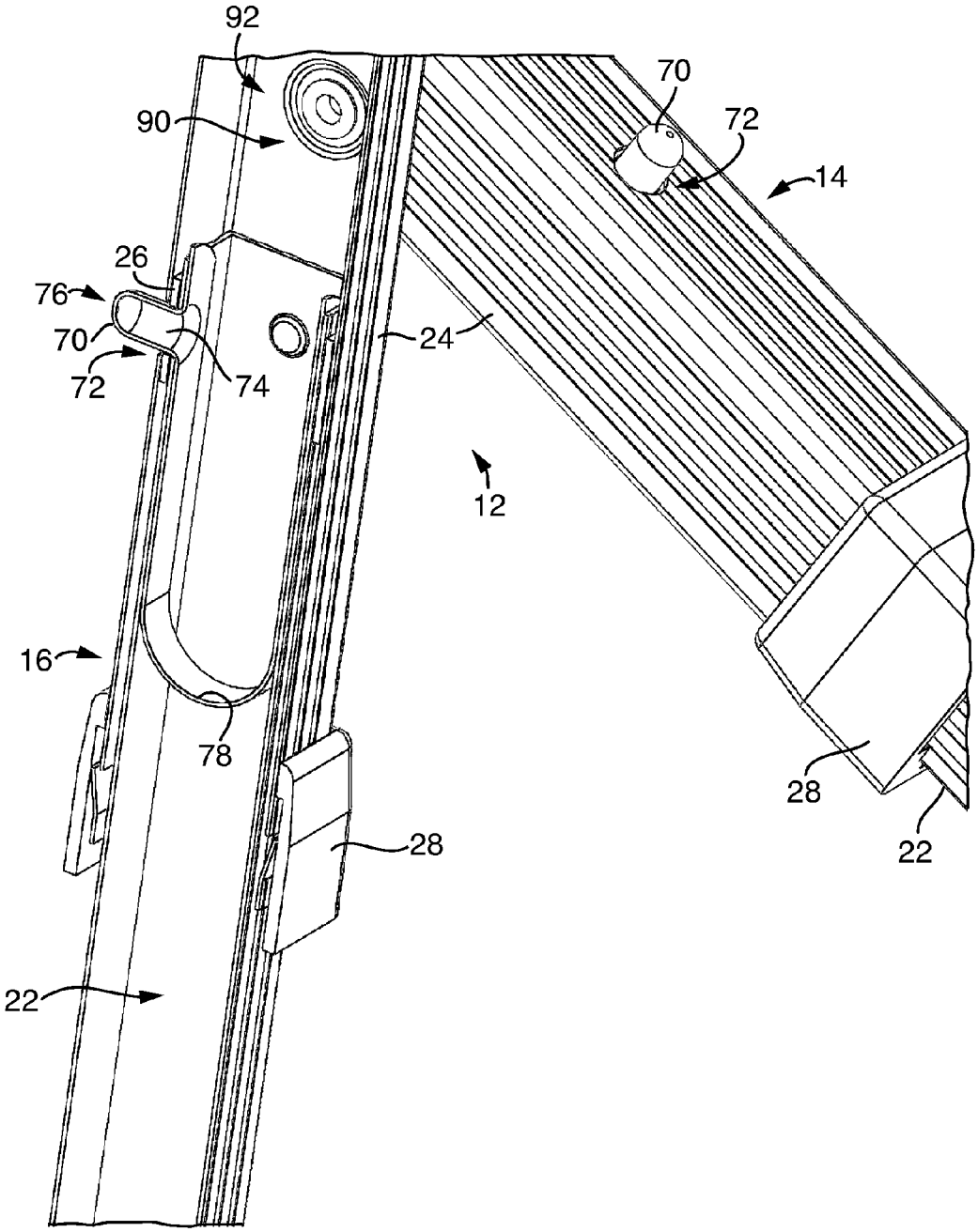
FIG. 3 is a close-up perspective and partially cut-away view of a leg assembly of the table structure of FIG. 1.

To facilitate smooth telescoping of the lower leg section 22 relative to the upper leg section 24, the lower leg section 22 includes a lower bushing 26 mounted on the upper end of the lower leg section 22, as shown in FIG. 3, that acts as a seal between the lower leg section 22 and the upper leg section 24. The upper leg section 24 includes a cap 28 disposed on the outer surface of the lower end of the upper leg section 24.

In alternate embodiments of the leg assemblies 12, the lower leg section 22 can be telescopically adjusted to various desired lengths for the legs 14 and 16 corresponding to various desired table heights.

Referring to FIG. 1, the lower ends of the lower leg sections 22 each include a resilient foot 40 for contacting a ground or floor surface and maintaining the tabletop 20 in a generally horizontal position when the table 10 is set up.

As further shown, the first legs 14 of each leg assembly 12 are generally disposed in a common plane when the leg assemblies 12 are opened. The lower ends of each first leg 14 are connected in fixed relationship to each other by a rigid connecting member 42 generally extending between the legs 14 within the same common plane. Likewise, the upper ends of each first leg 14 are connected in fixed relationship to each other by a rigid laterally outwardly offset connecting member 44 generally extending between the legs 14 parallel to common plane thereof, as shown in FIG. 2. Similarly, the second legs 16 of each leg assembly 12 are generally disposed in a common plane when the leg assemblies 12 are opened. The lower ends of each second leg 16 are connected in fixed relationship to each of the by a rigid laterally outwardly offset connecting member 46 generally extending between the legs 16 parallel to the common plane thereof. Owing to the design of the table 10, a similar connecting member is not required for the upper ends of each second leg 16 so as not to interfere with the folding of the tabletop parts, as discussed further below. In alternate embodiments, however, a connecting member could be provided in a manner that stabilized the upper ends of the second legs 16 without interfering with the folding of the tabletop 20 and without departing from the spirit and principles of the present invention.

Referring to FIG. 2, the connecting members 42, 44 and 46 maintain the relative positioning of the leg assemblies 12 to one another, increase the structural integrity of the table 10 in its set-up condition, and facilitate collapsing of the table 10 by coordinating movement of the leg assemblies 12 so that, for example, the grouped legs of respective leg assemblies 12 move between the open and closed conditions substantially simultaneously.

Figure 4:
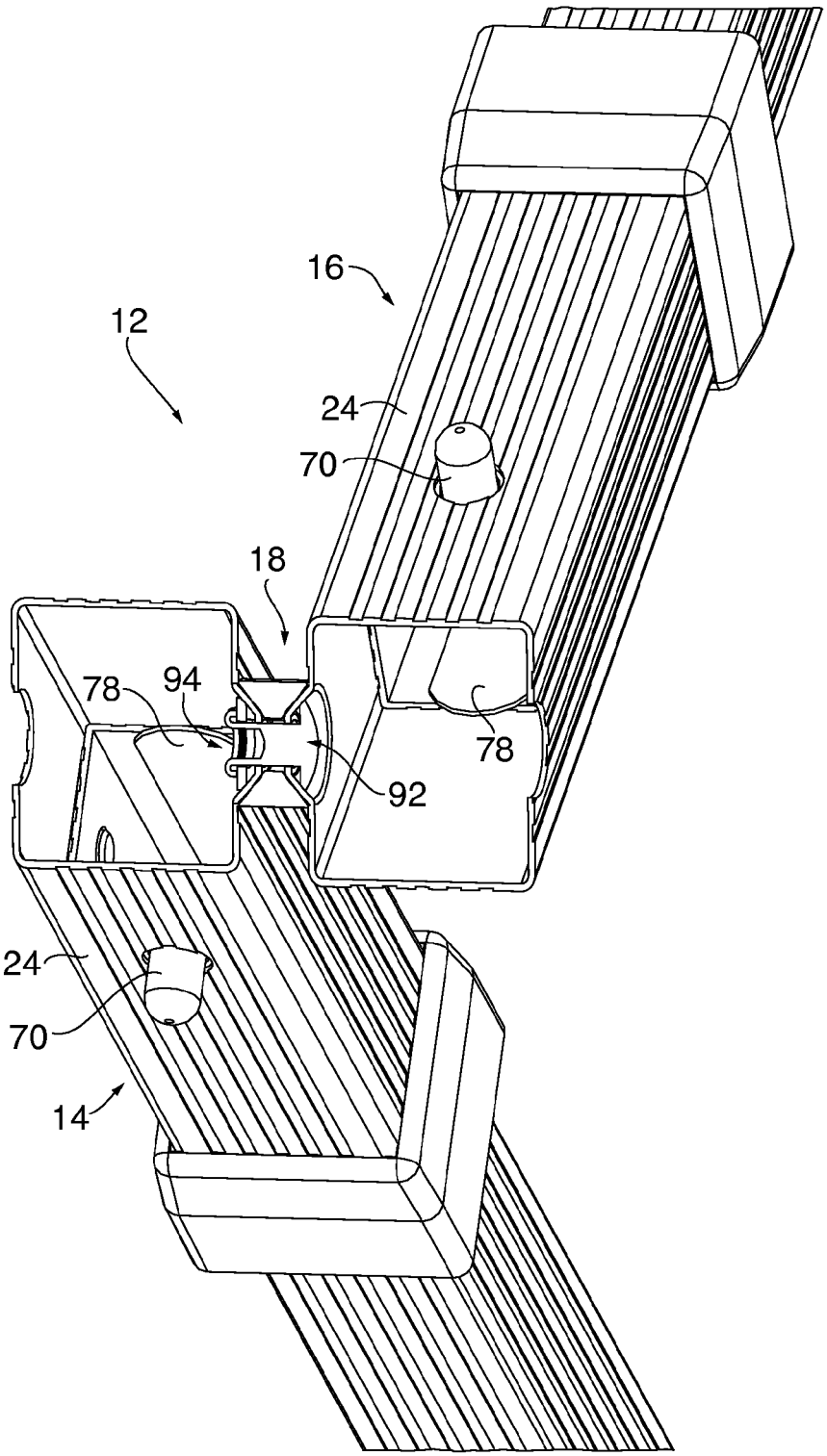
FIG. 4 is a close-up perspective view of a leg assembly of the table structure of FIG. 1 taken along line 4-4.

Referring to FIG. 4, the tabletop 20 is preferably divided into two parts, with each part being connected to a respective planar group of first legs 14 or second legs 16. More particularly, the set-up table 10 shown in FIG. 1 includes two leg assemblies 12, each comprising a first leg 14 and a second leg 16 pivotally attached to the underside of the tabletop 20. More particularly, a first tabletop part 50 is pivotally connected to the first leg 14 of each leg assembly 12 via support members 52 fixed to the underside of the first tabletop part 50. A second tabletop part 54 is pivotally connected to the second leg 16 of each leg assembly 12 via support members 56 fixed to the underside of the second tabletop part 54. In the set-up condition of the table 10 (FIGS. 1-2), the first and second tabletop parts 50 and 54 meet to form and collectively define a generally planar tabletop surface and the first and second legs 14 and 16 of each leg assembly 12 are disposed in the open condition, generally resembling an X-shaped configuration. In the collapsed condition of the table 10 (FIGS. 6 and 8), the first and second legs 14 and 16 of each leg assembly 12 are disposed in the closed condition, with each leg 14 and 16 being generally parallelly disposed in a common plane. The first tabletop part 50 is pivoted down on one side of the closed leg assemblies 12 and the second tabletop part 54 is pivoted down on the other side of the closed leg assemblies 12. As so folded, the first and second tabletop parts 50 and 54 are generally parallel to the legs 14 and 16.

Figure 5:
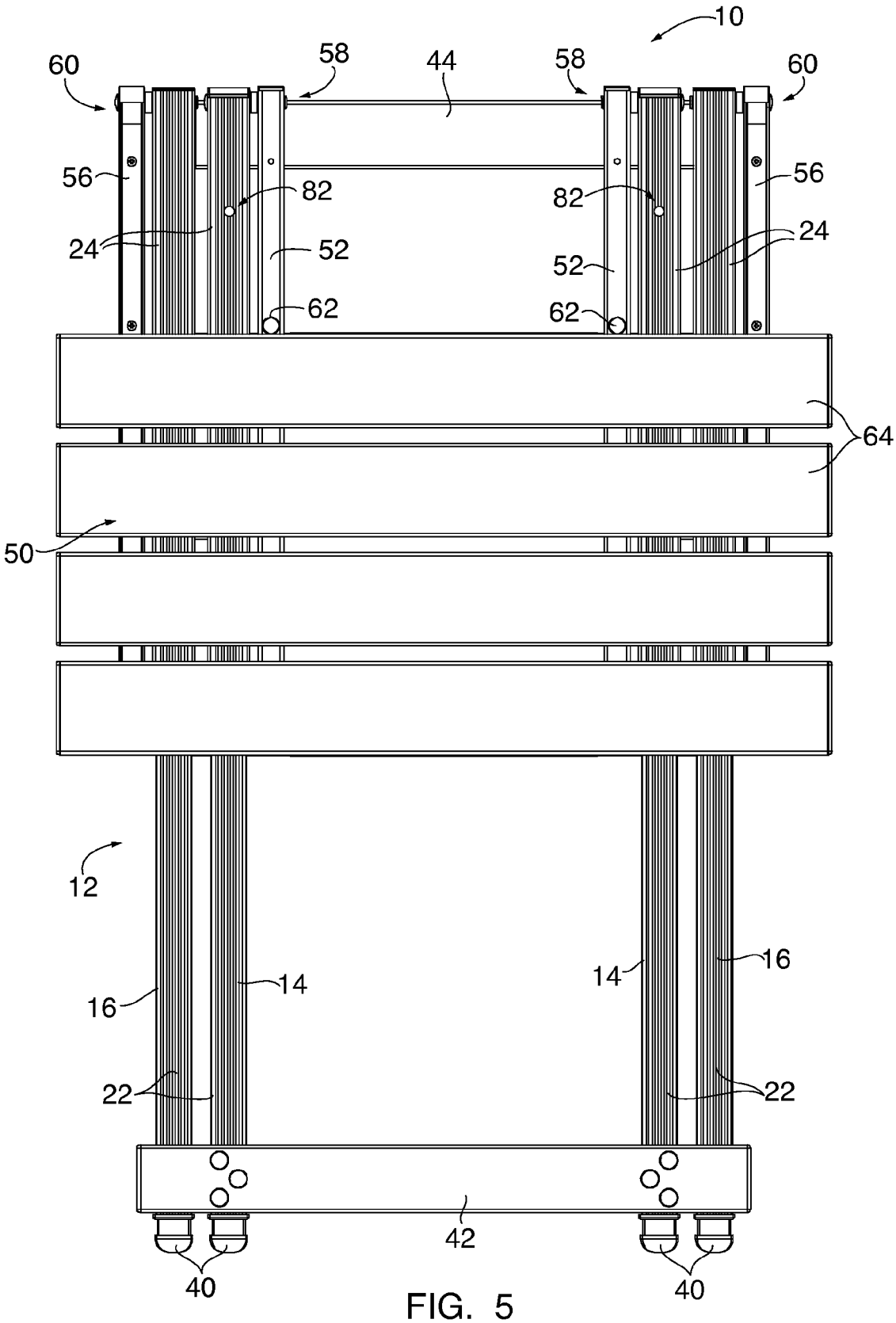
FIG. 5 is a planar side view of the table structure of FIG. 1 in a partially collapsed condition in accordance with the present invention.
Figure 7:
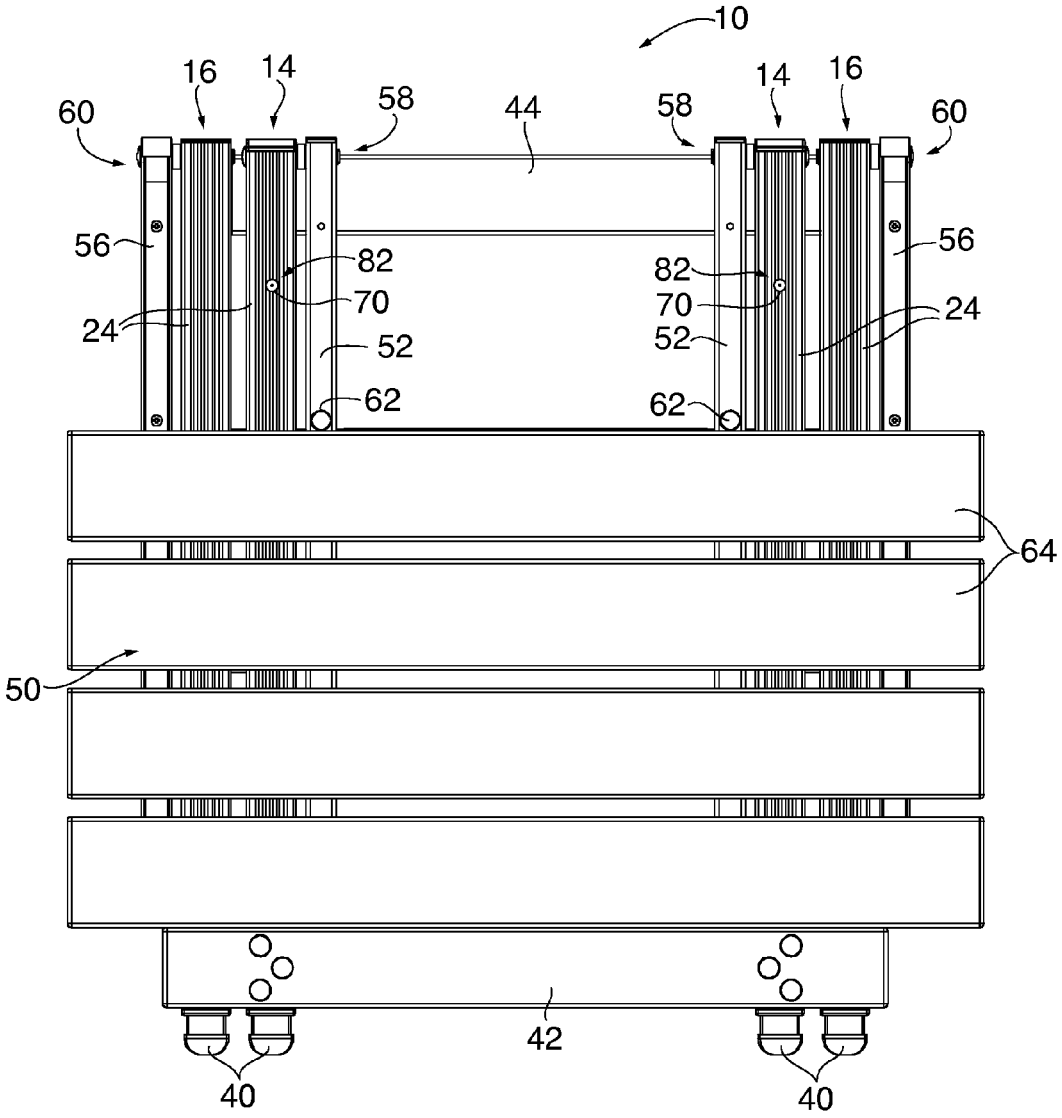
FIG. 7 is a planar side view of the table structure of FIG. 1 in a fully collapsed condition in accordance with the present invention.

As can be seen more clearly in FIGS. 5 and 7, the support members 52 of the first tabletop part 50 are disposed inwardly from the first legs 14 such that when the table 10 is collapsed, they are disposed within the common plane of the closed leg assemblies 12 between the legs 14. Additionally, the support members 56 of the second tabletop part 54 are disposed outwardly from the second legs 16 such that when the table 10 is collapsed, they are disposed within the common plane of the closed leg assemblies 12 outside of the legs 16. The first support members 52 are pivotally connected to the upper ends of the first legs 14 via pivot pins 58. Likewise, the second support members 56 are pivotally connected to the upper ends of the second legs 16 via pivot pins 60.

Each tabletop part 50 and 54 only extends over a portion of the respective support members 52 and 56, with the remainder of the support members 52 and 56 freely extending away from the tabletop part to the pivotal connection point 58 and 60 with a respective leg. In this way, when the table 10 is set up, the support members 52 of the first tabletop part 50 overlap with the second tabletop part 54, and vice versa, to form a planar tabletop surface, for example, as illustrated in FIG. 2. As further shown in FIGS. 5 and 6, the top surface of each support member 52 and 56 includes guide projections or stops 62 for aligning the tabletop parts 50 and 54 and maintaining such alignment of the tabletop parts 50 and 54. As illustrated, the each tabletop part 50 and 54 is formed by a plurality of slats 64, which collectively define the planar tabletop surface generally maintained in a horizontal position when the table 10 is set up. The guide projections 62 may comprise upwardly extending projections that are received between slats 64 to properly orient and align the tabletop parts 50 and 54 relative to one another in the set-up condition of the table 10.

Further, and in accordance with the present invention, means for locking each of the four illustrated telescopically extendible and retractable lower leg sections 22 in extended positions are provided. Specifically, each leg 14 and 16 includes a locking mechanism whereby the telescoping lower leg section 22 can be locked in place relative to the upper leg section 24, particularly when the former is extended from the latter to a desired telescopically-adjusted length. In preferred embodiments such as shown in FIGS. 1-3, the locking mechanism comprises a spring-biased detent button 70, operatively positioned in and carried by the lower leg section 22, that is biased outwardly therefrom and into engagement with the upper leg section 24. More particularly, the detent button 70 is biased outwardly through at least one aperture 72 formed in the wall of the upper leg section 24 to lock the lower leg section 22 in an extended condition relative to the upper leg section 24. Referring to FIG. 3, the detent button 70 comprises a cylindrical body portion 74 terminated at one end by a partly spherical free end portion 76 and attached at the other end to a spring 78 disposed within the hollow of the lower leg section 22. The cylindrical portion 74 of the projected detent button 70 is received within an associated aperture 72 in the upper leg section 24 to lock the lower leg section 22 in place. Each aperture 72 formed in the upper leg section 24 corresponds to a desired length of the extended leg 14 or 16. Indeed, multiple apertures can be provided so that the detent button 70 can be used to lock the legs at various telescopically adjusted lengths corresponding to the positioning of the apertures.

Figure 9:
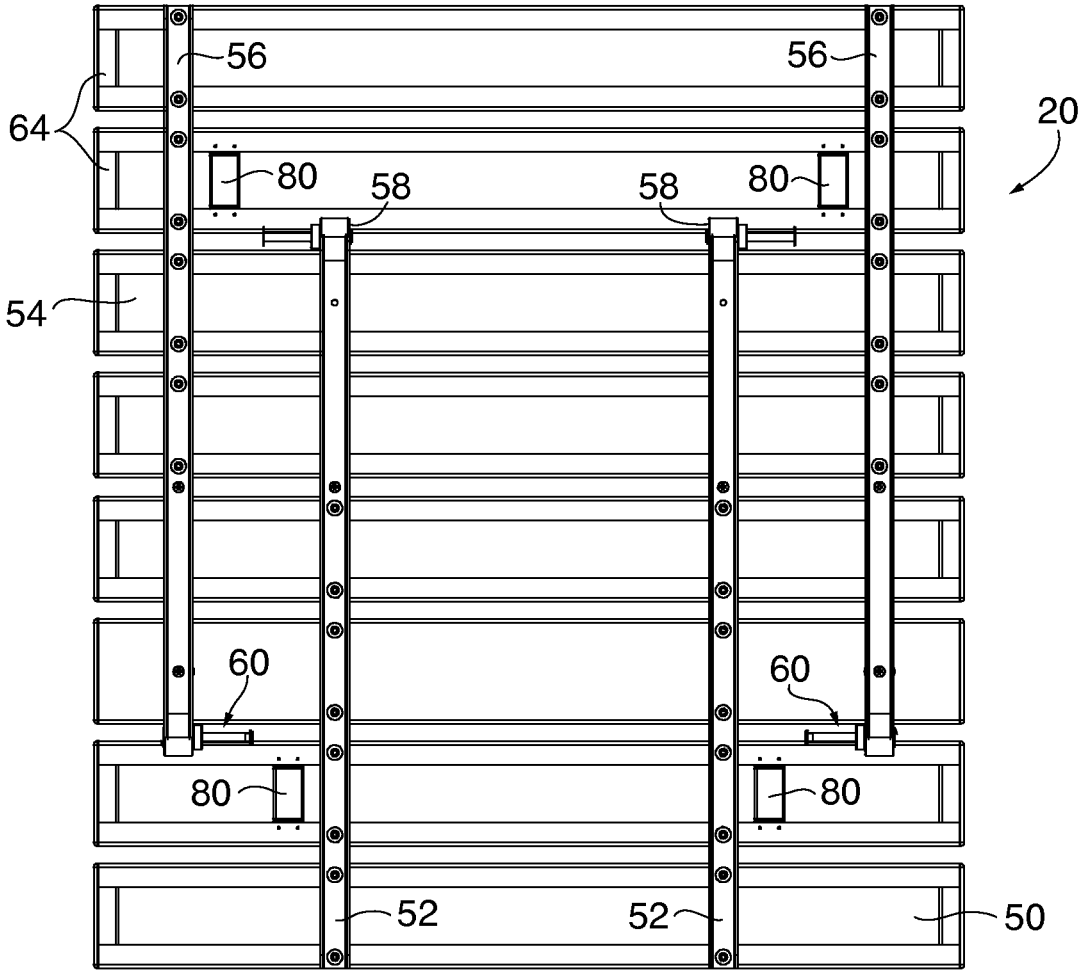
FIG. 9 is a planar view of the underside of an embodiment of a tabletop used in the table structure of FIG. 1 in accordance with the present invention.

The present invention further provides an automatically releasing mechanism to release the locking means of each leg and to facilitate rapid telescopic collapsing of the lower leg sections 22 to retracted positions within respectively associated upper leg sections 24. As shown in FIG. 9, each tabletop part 50 and 54 may be provided with bumpers 80 on the underside thereof for facilitating retraction of all the lower leg sections 22 of the table 10 during collapsing thereof. Specifically, the bumpers 80 are positioned so that they align with and engage the detent buttons 70 extending through the apertures 72 in each upper leg section 24 associated with a set-up length for the legs 14 and 16 when the tabletop parts 50 and 54 are folded down the sides of the closed leg assemblies 12, as shown in FIG. 6. Preferably, when the tabletop parts 50 and 54 are moved to the illustrated closed conditions—i.e., generally adjacent to and abutting a respective pair of legs—the bumpers 80 engage and push the detent buttons 70 for each lower leg section 22 into the leg 14 or 16, thereby releasing the buttons 70 from the respective apertures 72 in each of the upper leg sections 24 so that the legs 14 and 16 can be collapsed with the lower leg sections 22 being telescopically retracted within their respective upper leg sections 24 until the table 10 is in its fully collapsed condition. More preferably, the bumpers 80 coordinate retraction of all the legs 14 and 16 so that the detent buttons 70 for all the legs 14 and 16 are released substantially simultaneously. In this situation, the user can grasp the first and second tabletop parts 50 and 54 sandwiched around the closed leg assemblies 12. By squeezing the tabletop parts 50 and 54 together, the bumpers 80 engage all the detent buttons 70 together. At the same time, the user can apply a downward force to the tabletop parts 50 and 54, which will cause the lower leg sections 22, supported by a surface such as the ground or the floor, to retract into the upper leg sections 24. As a result, collapsing of the table 10 can be facilitated and simplified compared to a prior art table structure that requires each telescoping leg to be separately collapsed, often one at a time.

To set up the table 10 from its fully collapsed condition, the user simply pulls on the legs 14 and 16 to extend the lower leg sections 22 from the upper leg sections 24, for example, using the lower connecting members 42 and 46, until the lower leg sections 22 are at the desired length. The detent buttons 70 can automatically lock the lower leg sections 22 into place when they are biased through the apertures 70 in the upper leg sections 24. Once the legs 14 and 16 are extended to the desired length, the user can open the leg assemblies 12 to the X-shaped configuration, preferably by lifting the tabletop parts 50 and 54 until the leg assemblies 12 are opened and then setting them on top of the opened leg assemblies 12, as aligned with one another, to form a planar tabletop surface. In this regard, the guide projections 62 can assist in aligning the tabletop parts 50 and 54 by ensuring that said projections 62 fit the space between slats 64 to properly orient the tabletop parts 50 and 54 relative to one another.

In embodiments of the present invention, "storage" apertures 82 can be provided on the upper end of the upper leg sections 24 to lock the lower leg sections 22 at a fully retracted position within the upper leg sections 24. For example, when the lower leg sections 22 are retracted into the upper leg sections 24, the detent buttons 70 can engage the upper apertures 82 (as illustrated in FIG. 8) to hold the legs 14 and 16 in a shortened condition and prevent the lower leg sections 22 from accidentally extending out of the upper leg sections 24 during storage and/or transport. The detent buttons 70 can be disengaged from the upper apertures 82 simply by applying a sufficient pulling force on the lower leg sections 22 and/or lower connecting members 42 and 46 to overcome the spring force biasing the detent buttons 70 into the upper apertures.

The bumpers 80 formed on the underside of the tabletop parts 50 and 54 can be separate pieces precisely aligned with the location of the detent buttons 70 in desired set-ups of the table 10. For example, if the table 10 has several apertures associated with various leg lengths and table heights, more than one bumper 80 may be positioned on the underside of the tabletop parts 50 and 54 to ensure engagement between a bumper 80 and the detent button 70 regardless of location of the detent button 70 or length of the legs 14 and 16. Alternatively, the underside of the tabletop parts 50 and 54 could be solid, in which case the solid surface of the tabletop parts 50 and 54 act to automatically release the detent buttons 70 upon contact.

In accordance with the present invention, each leg assembly 12 includes a central pivot coupling 18 that enables angular movement of the pairs of longitudinally elongated legs 14 and 16 about an unintruding common axis in one and an opposite angular direction, relative to each other between closed and open conditions of the leg assemblies 12. Referring to FIGS. 2-4, the first and second leg 14 and 16 of each leg assembly 12 are centrally coupled with inwardly facing exterior surfaces in face-to-face relation, as shown. More specifically referring to FIGS. 2-3, central pivot coupling 18 is provided by a rivet 90, which serves as a pivot pin. The head of the rivet 90 is received within an outwardly open counter bore 92 in the inner wall of one of the first and second legs 14 or 16 whereas the upset end of the rivet 90 is received within another counter bore 94 in the other leg. As is evident herein, the countersunk rivet 90 provides means for enabling angular movement of the legs 14 and 16, relative to each other, about the unintruding common axis of support for the legs 14 and 16. Generally, the unintruding common axis is at all times in a fixed position relative to the upper leg sections 24. Additionally, the countersunk rivet 90 permits the lower leg sections 22 to be freely movable through and transversely of the unintruding common axis when moving between extended and retracted positions. In this regard, telescoping movement of the lower leg sections 22 within the upper leg sections 24 is not impeded or otherwise restricted by the presence of the rivet 90 or any pivot pin coupling the legs 14 and 16 together. Accordingly, the collapsed dimension of the leg assemblies 12 is greatly reduced because the lower leg sections 22 can be retracted into almost the entire length of the upper leg sections 24. As a result, the smaller dimension of the closed and fully collapsed leg assemblies does not compromise the usable table height, in any way, and vice versa, which obviates significant drawbacks of prior art tables with partially telescoping leg members.

FIGS. 2, 5 and 7 illustrate successive steps performed in collapsing a table 10 from open or set-up condition to closed or fully collapsed condition in accordance with the present invention. FIG. 2 shows the table 10 in an open and set-up condition. In the open condition, the crossed leg assemblies 12 present a generally X-shaped configuration and the first and second tabletop parts 50 and 54 abut one another to collectively form a generally planar tabletop surface. FIG. 5 shows the table 10 after the leg assemblies 12 have been pivoted to a closed condition where the first and second legs 14 and 16 of each leg assembly 12 are generally parallelly disposed in a common plane. Additionally, each tabletop part 50 and 54 has been pivoted down on respective side of the closed leg assemblies 12 to positions generally parallel to and sandwiching the closed leg assemblies 12. At this stage, the bumpers 80 on the underside of the tabletop parts 50 and 54 contact and release the detent buttons 70. FIG. 7 shows the table 10 in a closed and fully collapsed condition. After the bumpers 80 contact and release the detent buttons 70, the lower leg sections 22 are retracted within the upper leg sections 24 to compress the dimension of the collapsed table 10, as shown.

The foregoing description of embodiments of the invention has been presented for the purpose of illustration and description. It is not intended to be exhaustive or to limit the invention to the form disclosed. Obvious modifications and variations are possible in light of the above disclosure. The embodiments described were chosen to best illustrate the principles of the invention and practical applications thereof to enable one of ordinary skill in the art to utilize the invention in various embodiments and with various modifications as suited to the particular use contemplated.

I claim:

1. A collapsible table structure comprising:

a tabletop;

a plurality of folding leg assemblies pivotally attached to the underside of the tabletop, each of said plurality of leg assemblies comprising:

a first leg including a first upper leg section and a first lower leg section telescopically received within said first upper leg section for adjusting the length of said first leg between a retracted position and an extended position;

and a second leg including a second upper leg section and a second lower leg section telescopically received within said second upper leg section for adjusting the length of said second leg between a retracted position and an extended position;

wherein said first and second legs of each leg assembly are connected to each other by a pivot coupling for pivotal movement between an open condition of the leg assembly where the legs are positioned relative to one another to generally resemble an X-shaped configuration, and a closed condition of the leg assembly wherein the first and second legs are generally parallelly disposed in a common plane;

wherein the pivot coupling defines an unintruding common axis between the first and second legs, said first and second lower leg sections for each of said leg assemblies being freely movable through and transversely of said unintruding common axis in moving between said extended and retracted positions; and wherein the tabletop is connected to each of said plurality of leg assemblies so as to be capable of pivoting to be parallelly disposed relative to the legs of each leg assembly when said leg assemblies are in said closed condition.

2. The collapsible table structure according to claim 1, wherein the tabletop comprises:

a first tabletop part pivotally connected to the first leg of each of the plurality of leg assemblies; and a second tabletop part pivotally connected to the second leg of each of the plurality of leg assemblies;

such that in a set-up condition of the table structure, where each of the leg assemblies is in its open condition and the first and second legs of each leg assembly generally resemble an X-shaped configuration, the first and second tabletop parts collectively define a generally planar tabletop surface; and such that further in a collapsed condition of the table structure, where each of the leg assemblies is in its closed condition and the first and second leg of each leg assembly are generally parallelly disposed in a common plane, the first tabletop part is generally parallelly disposed on one side of the closed leg assemblies and the second tabletop part is generally parallelly disposed on the other side of the closed leg assemblies.

3. The collapsible table structure according to claim 2, further comprising means for locking each leg in at least one telescopically adjusted length.

4. The collapsible table structure according to claim 3, wherein said locking means comprise a spring-biased detent button carried by the lower leg section and biased outwardly therefrom and into engagement with the upper leg section.

5. The collapsible table structure according to claim 4, wherein the upper leg section includes at least one aperture that receives the detent button to lock the leg in the extended position.

6. The collapsible table structure according to claim 5, further comprising means for releasing the locking means of each leg, wherein said releasing means comprise at least one bumper associated with each leg of the table structure and being positioned on the underside of one of the first and second tabletop parts in alignment with the at least one aperture in the respective upper leg section so that when the first and second tabletop parts are moved to their respective closed conditions said bumpers engage and release the detent buttons projecting through the apertures.

7. The collapsible table structure according to claim 5, further comprising means for releasing the locking means of each leg.

8. The collapsible table structure according to claim 7, wherein the locking means for every leg of the table structure are substantially simultaneously released using the releasing means.

9. The collapsible table structure according to claim 1, wherein the first legs of each of the plurality of leg assemblies are connected by at least one first connecting member and the second legs of each of the plurality of leg assemblies are connected by at least one second connecting member so that said first legs and said second legs are maintained within respective common planes and the pivoting movement of each of the leg assemblies is coordinated with the pivoting movement of the other leg assemblies.

10. The collapsible table structure according to claim 1, wherein the pivot coupling comprises a rivet having a head and an upset end, said head being received by an outwardly open counter bore formed in the inner wall of one of the first and second legs and said upset end being received by an outwardly open counter bore formed in the inner wall of the other of the first and second legs.

11. A collapsible table structure comprising:

a first and a second leg assembly, each having a pair of longitudinally elongated legs, said legs having a plurality of longitudinally extendable and retractable sections movable between extended and retracted positions relative to each other;

means for enabling angular movement of said pairs of legs about an unintruding common axis in one and an opposite angular direction, relative to each other between closed and open conditions of said first and second leg assemblies, said legs in said closed condition being longitudinally parallel to each other, said legs in said open condition crossing each other at said unintruding common axis and presenting an X-shaped configuration, said extendable and retractable sections being freely movable through and transversely of said unintruding common axis in moving between said extended and retracted positions;

a tabletop pivotally connected atop each of the first and second leg assemblies, said tabletop comprising:

a first tabletop part pivotally connected to a first leg of each of the first and second leg assemblies; and a second tabletop part pivotally connected to a second leg of each of the first and second leg assemblies;

such that in a set-up condition of the table structure, where each of the leg assemblies is in its open condition and the pair of legs of each leg assembly generally resemble an X-shaped configuration, the first and second tabletop parts collectively define a generally planar tabletop surface; and such that in a collapsed condition of the table structure, where each of the leg assemblies is in its closed condition and the first and second leg of each leg assembly are longitudinally parallel to each other, the first tabletop part having a closed condition wherein said tabletop part is generally parallelly disposed on one side of the closed leg assemblies and the second tabletop part having a closed condition wherein said tabletop part is generally parallelly disposed on the other side of the closed leg assemblies;

wherein said sections of each of said legs includes a lower leg section, and wherein each leg of said first and second leg assembly includes locking means for retaining said lower leg section of said legs in said extended position; and wherein said table structure includes means for releasing each of said locking means when said legs are in said closed condition and said tabletop parts move into their respective closed conditions.

12. The collapsible table structure according to claim 11, wherein the first legs of each of the plurality of leg assemblies are connected by at least one first connecting member and the second legs of each of the plurality of leg assemblies are connected by at least one second connecting member so that said first legs and said second legs are maintained within respective common planes and the pivoting movement of each of the leg assemblies is coordinated with the pivoting movement of the other leg assemblies.

13. The collapsible table structure according to claim 11, wherein means for enabling angular movement comprises a pivot coupling defining the unintruding common axis.

14. The collapsible table structure according to claim 13, wherein the pivot coupling comprises a rivet having a head and an upset end, said head being received by an outwardly open counter bore formed in the inner wall of one of the first and second legs and said upset end being received by an outwardly open counter bore formed in the inner wall of the other of the first and second legs.

15. The collapsible table structure according to claim 11, wherein said sections of each of said legs includes an upper leg section, and said locking means comprise a spring-biased detent button carried by the lower leg section and biased outwardly therefrom and into engagement with the upper leg section.

16. The collapsible table structure according to claim 15, wherein said upper leg section includes at least one aperture that receives the detent button to lock the lower leg section in the extended position.

17. The collapsible table structure according to claim 16, wherein said releasing means comprise at least one bumper associated with each leg of the table structure and being positioned on the underside of one of the first and second tabletop parts in alignment with the at least one aperture in the respective upper leg section so that when the first and second tabletop parts are moved to their respective closed conditions said bumpers engage and release the detent buttons projecting through the apertures.

18. The collapsible table structure according to claim 11, wherein the locking means for every leg of the table structure are substantially simultaneously released using the releasing means.

* * * * *

UNITED STATES PATENT AND TRADEMARK OFFICE

CERTIFICATE OF CORRECTION

PATENT NO. : 9,119,465 B2
APPLICATION NO. : 14/044321
DATED : September 1, 2015
INVENTOR(S) : Daniel R. Grace It is certified that error appears in the above-identified patent and that said Letters Patent is hereby corrected as shown below:

In the Claims

In Claim 7, Column 11, line 11: "after according to claim" please delete "5" and insert --3--.

Signed and Sealed this
Fifth Day of July, 2016

Michelle K. Lee

Michelle K. Lee
*Director of the United States Patent and Trademark Office*